US006390235B1

(12) United States Patent
Tsay

(10) Patent No.: US 6,390,235 B1
(45) Date of Patent: May 21, 2002

(54) EMERGENCY ESCAPE DEVICE FOR BUILDINGS

(76) Inventor: Deng-Kae Tsay, No. 3, Lane 186, Chung-Cheng Rd., Bao-Chung Hsiang, Yunlin Hsien (TW)

( * ) Notice: Subject to any disclaimer, the term of this patent is extended or adjusted under 35 U.S.C. 154(b) by 0 days.

(21) Appl. No.: 09/877,951

(22) Filed: Jun. 8, 2001

(51) Int. Cl.[7] ..... A62B 1/00
(52) U.S. Cl. ..... 182/44; 182/42
(58) Field of Search ..... 182/42–44

(56) References Cited

U.S. PATENT DOCUMENTS 780,795 A * 1/1905 Hansen ..... 182/44
2,963,178 A * 12/1960 Walker ..... 182/42
4,209,077 A * 6/1980 Yui ..... 182/42
4,570,750 A * 2/1986 Tsai ..... 182/44
5,645,139 A * 7/1997 Liou ..... 182/42
6,298,945 B1 * 10/2001 Anders ..... 182/68.1

* cited by examiner

*Primary Examiner*—Alvin Chin-Shue
(74) *Attorney, Agent, or Firm*—Ladas & Parry

(57) ABSTRACT

An emergency escape device includes a hollow frame body adapted to be mounted on an uppermost floor of a building, and having first, second and third chain shafts mounted rotatably thereon. A transmission unit couples the first chain shaft to a motor unit. A ladder unit includes right and left endless chains, each of which has an upper chain portion extending into the frame body and a lower chain portion disposed downwardly and outwardly of the frame body. The upper chain portions of the right and left endless chains are trained in sequence on first, third and second chain wheels mounted respectively on the first, third and second chain shafts. Linking bars are spacedly disposed to interconnect the right and left endless chains.

3 Claims, 7 Drawing Sheets

EMERGENCY ESCAPE DEVICE FOR BUILDINGS

BACKGROUND OF THE INVENTION

1. Field of the Invention

The invention relates to an emergency escape device for buildings, more particularly to an emergency escape device adapted to be installed on a building to help occupants get out of the building during an emergency.

2. Description of the Related Art

Fire accidents in buildings can be disastrous. Therefore, there is a need for an escape device which can help occupants of a building that is on fire get out of the building within a very short time.

SUMMARY OF THE INVENTION

Therefore, the main object of the present invention is to provide an emergency escape device adapted to be installed on a building so as to help occupants get out of the building during an emergency.

Accordingly, an emergency escape device of the present invention is adapted to be installed on a building, and includes a hollow frame body, a drive unit, and a ladder unit. The frame body is adapted to be mounted on an outer wall surface of an uppermost floor of the building, and has left and right sides opposite to each other in a first direction, and front and rear sides opposite to each other in a second direction transverse to the first direction. The drive unit includes first, second and third chain shafts, a bi-directional motor unit, and a transmission unit. The first chain shaft is mounted rotatably on the frame body, and extends in the first direction adjacent to the front side of the frame body. The first chain shaft has left and right end portions, each of which has a first chain wheel mounted thereon. The second chain shaft is mounted rotatably on the frame body, and extends in the first direction adjacent to the rear side of the frame body. The second chain shaft has left and right end portions, each of which has a second chain wheel mounted thereon. The third chain shaft is mounted rotatably on the frame body, and extends in the first direction. The third chain shaft is disposed between and at an elevation below the first and second chain shafts. The third chain shaft has left and right end portions, each of which has a third chain wheel mounted thereon. The motor unit is mounted on the frame body. The transmission unit couples the motor unit to the first chain shaft so as to transmit rotary drive power from the motor unit to the first chain shaft. The ladder unit includes right and left endless chains, and a plurality of linking bars. Each of the right and left endless chain has a curved upper chain portion extending into the frame body, a curved lower chain portion disposed downwardly and outwardly of the frame body, and an intermediate portion between the upper and lower chain portions. The upper chain portion of the right endless chain is trained in sequence on an upper part of one of the first chain wheels, a lower part of one of the third chain wheels, and an upper part of one of the second chain wheels. The upper chain portion of the left endless chain is trained in sequence on an upper part of the other one of the first chain wheels, a lower part of the other one of the third chain wheels, and an upper part of the other one of the second chain wheels. Each of the linking bars extends in the first direction, and has opposite ends connected respectively to the right and left endless chains. The linking bars are spaced apart from each other along lengths of the right and left endless chains.

BRIEF DESCRIPTION OF THE DRAWINGS

Other features and advantages of the present invention will become apparent in the following detailed description of the preferred-embodiment with reference to the accompanying drawings, of which.

DETAILED DESCRIPTION OF THE PREFERRED EMBODIMENT

Figure 1:
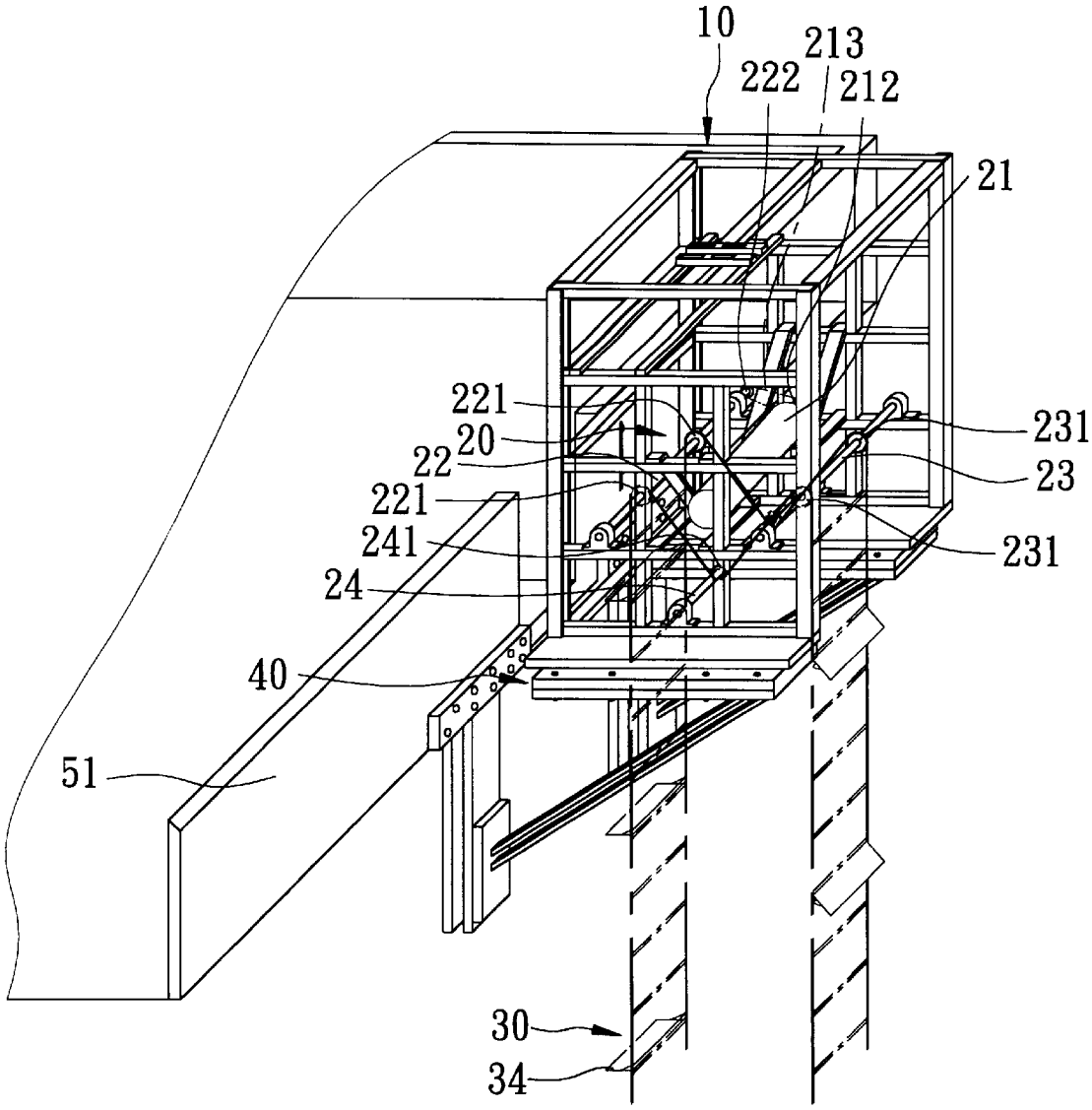
FIG. 1 is a fragmentary perspective view showing a preferred embodiment of an emergency escape device according to the invention when mounted on an uppermost floor of a building.
Figure 2:
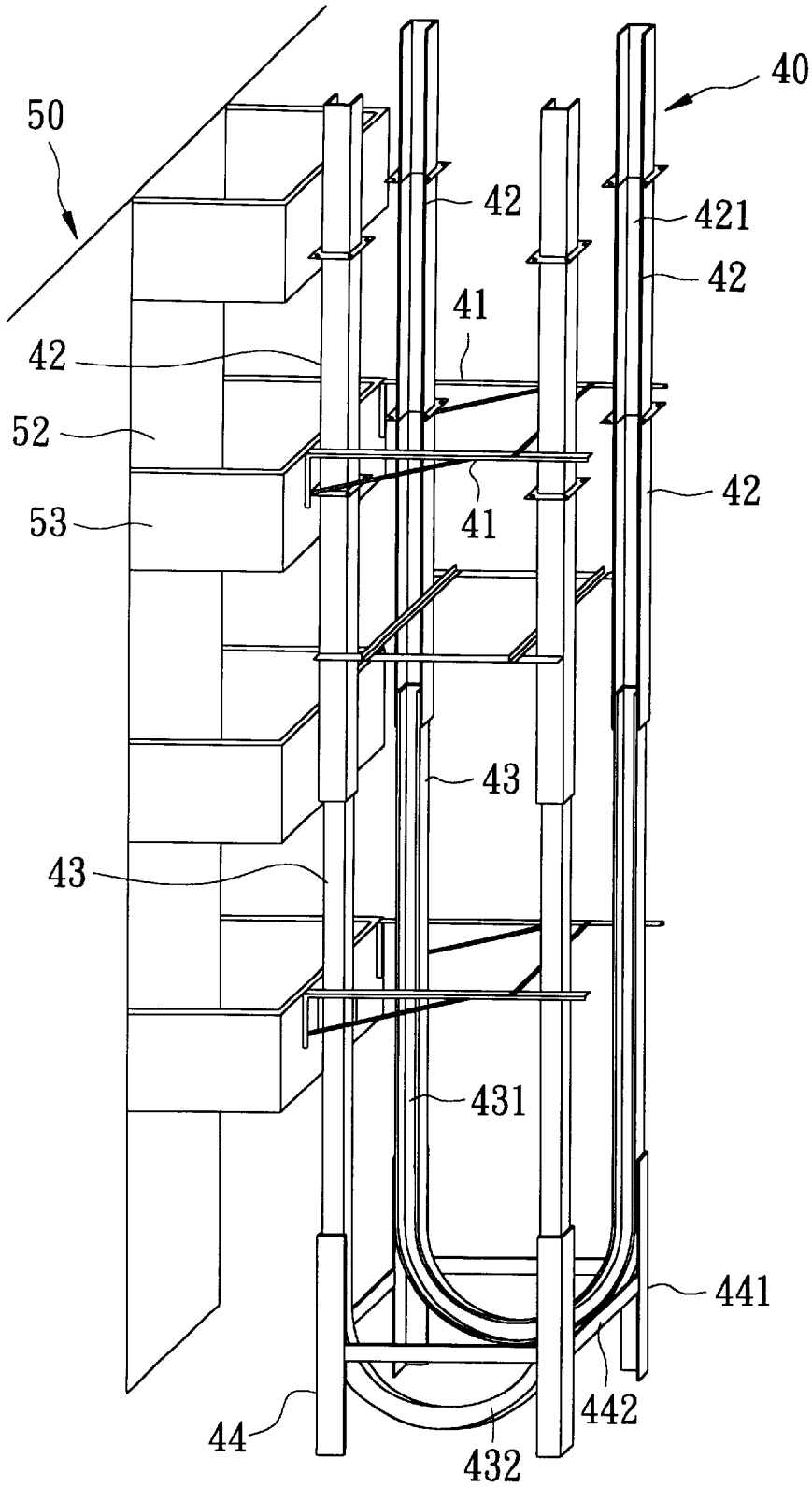
FIG. 2 is perspective view showing a ladder support unit of the preferred embodiment when mounted on the building.
Figure 3:
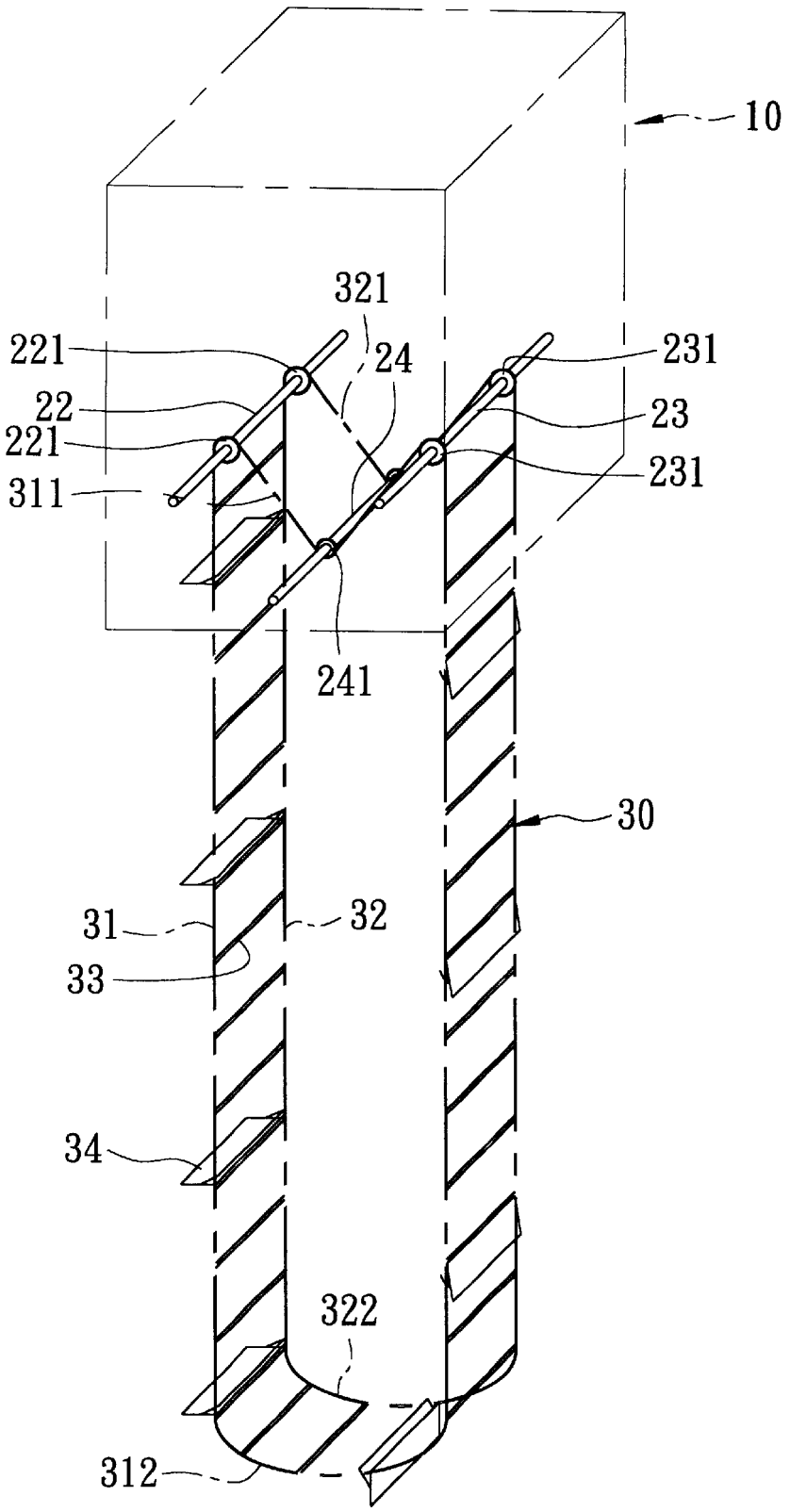
FIG. 3 is a fragmentary perspective view of the preferred embodiment.
Figure 4:
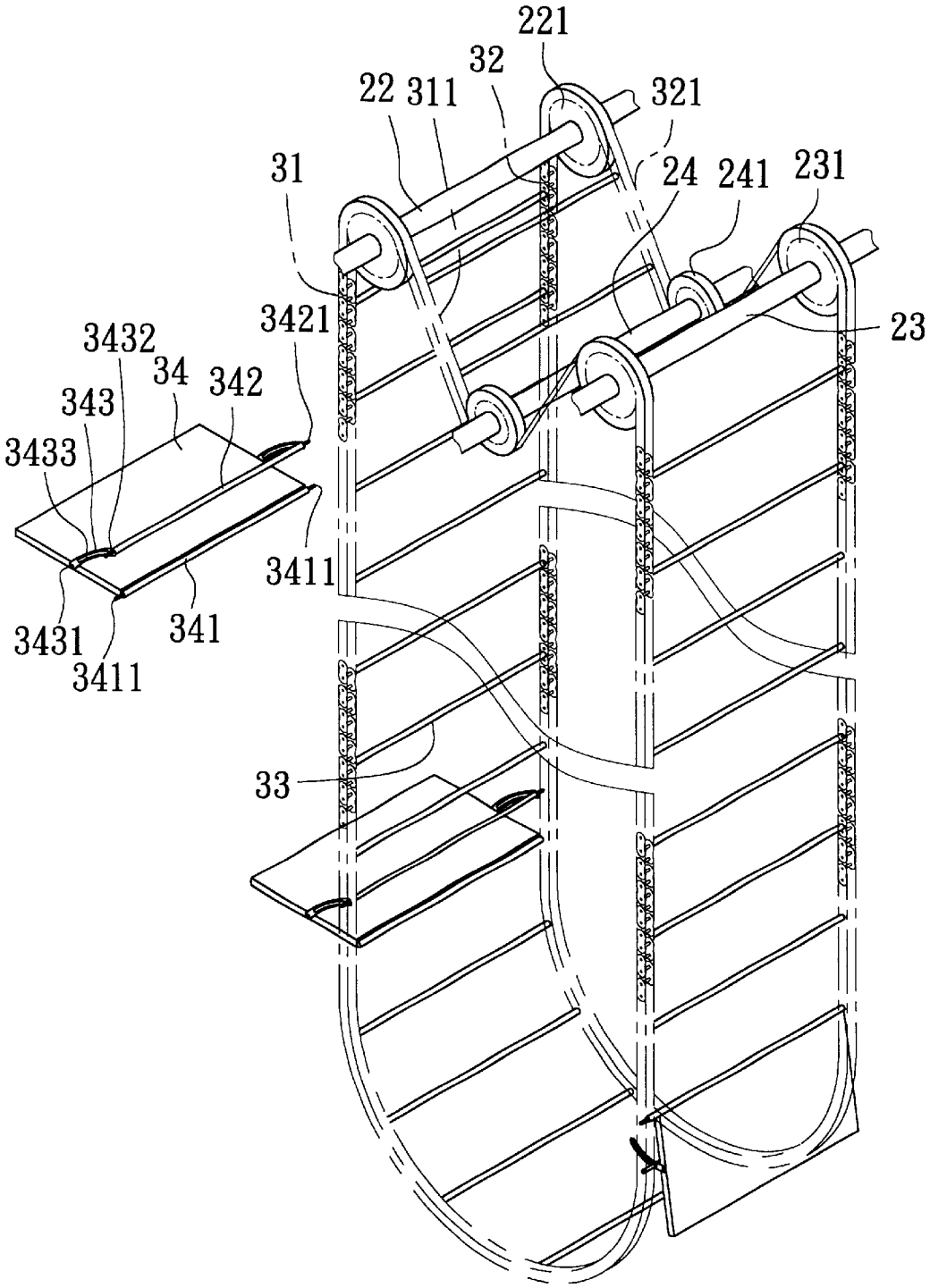
FIG. 4 is an exploded perspective view of the preferred embodiment in part.

With reference to FIGS. 1 to 4, the preferred embodiment of an emergency escape device according to the present invention is shown to be adapted for installation on a building 50. The emergency escape device includes a hollow frame body 10, a drive unit 20, and a ladder unit 30.

The frame body 10 is adapted to be mounted on an outer wall surface of an uppermost floor 51 of the building 50, and has left and right sides opposite to each other in a first direction, and front and rear sides opposite to each other in a second direction transverse to the first direction.

The drive unit 20 includes first, second and third chain shafts 22, 23, 24, a bi-directional motor unit 21, and a transmission unit. The first chain shaft 22 is mounted rotatably on the frame body 10, and extends in the first direction adjacent to the front side of the frame body 10. The first chain shaft 22 has left and right end portions, each of which has a first chain wheel 221 mounted thereon. The second chain shaft 23 is mounted rotatably on the frame body 10, and extends in the first direction adjacent to the rear side of the frame body 10. The second chain shaft 23 has left and right end portions, each of which has a second chain wheel 231 mounted thereon. The third chain shaft 24 is mounted rotatably on the frame body 10, and extends in the first direction. The third chain shaft 24 is disposed between and at an elevation below the first and second chain shafts 22, 23, and has left and right end portions, each of which has a third chain wheel 241 mounted thereon. The bi-directional motor unit 21 is mounted on the frame body 10. The transmission unit couples the motor unit 21 to the first chain shaft 22 so as to transmit rotary drive power from the motor unit 21 to the first chain shaft 22. The transmission unit includes a transmission wheel 212 driven by the motor unit 21, a belt pulley 222 mounted on the first chain shaft 22, and a belt 213 having one end trained on the transmission wheel 212 and an opposite end trained on the belt pulley 222.

The ladder unit 30 includes a right endless chain 31, a left endless chain 32, and a plurality of linking bars 33. The right endless chain 31 has a curved upper chain portion 311 extending into the frame body 10, a curved lower chain portion 312 disposed downwardly and outwardly of the frame body 10, and an intermediate portion between the upper and lower chain portions 311, 312. The upper chain portion 311 of the right endless chain 31 is trained in sequence on an upper part of one of the first chain wheels 221, a lower part of one of the third chain wheels 241, and an upper part of one of the second chain wheels 231.

The left endless chain 32 has a curved upper chain portion 321 extending into the frame body 10, a curved lower chain portion 322 disposed downwardly and outwardly of the frame body 10, and an intermediate portion between the upper and lower chain portions 321, 322. The upper chain portion 321 of the left endless chain 32 is trained in sequence on an upper part of the other one of the first chain wheels 221, a lower part of the other one of the third chain wheels 241, and an upper part of the other one of the second chain wheels 231.

Each of the linking bars 33 extends in the first direction, and has opposite ends connected respectively to the right and left endless chains 31, 32. The linking bars 33 are spaced apart from each other along lengths of the right and left endless chains 31, 32.

The emergency escape device further comprises a ladder support unit 40, which includes left and right stationary chain support frames 42, left and right U-shaped movable chain support frames 43, and a plurality of frame mounting members 41. Each of the stationary chain support frames 42 includes front and rear upright frame portions that are spaced apart from each other in the second direction and that respectively define a vertically extending chain groove 421. The chain grooves 421 in one of the stationary chain support frames 42 open toward the other one of the stationary chain support frames 42. Each of the U-shaped movable chain support frames 43 includes parallel branch portions that have upper sections extending telescopically and respectively into the chain grooves 421 of the upright frame portions of a corresponding one of the stationary chain support frames 42, and a curved connecting portion 432 interconnecting lower sections of the parallel branch portions. Each of the movable chain support frames 43 has a U-shaped chain groove 431 that is formed therealong and that opens toward the other one of the movable chain support frames 43. Each of the frame mounting members 41 is connected to one of the stationary chain support frames 42 at one end, and is adapted to be mounted on an outer wall portion 53 of a respective one of upper floors 52 of the building 50 at the other end, thereby securing the stationary chain support frames 42 on an upper part of the building 50.

The intermediate portion of each of the endless chains 31, 32 extends into the chain grooves 421 in a respective one of the stationary chain support frames 42. The lower chain portion 312, 322 of each of the endless chains 31, 32 is received in the chain groove 431 in a respective one of the movable chain support frames 43.

The ladder support unit 40 further includes a base frame 44 adapted to be disposed on a ground surface. The base frame 44 includes four upright sections 441 and four connecting sections 442 interconnecting the upright sections 441 to thereby confine an upwardly opening receiving space that permits extension of the movable chain support frames 43 therein when the movable chain support frames 43 are extended downwardly from the stationary chain support frames 42 so as to position the movable chain support frames 43 relative to the ground surface.

The emergency escape device further includes a plurality of foldable platform members 34. Each of the platform members 34 includes a rectangular platform body, first and second mounting shafts 341, 342, and a pair of linking plates 343. The platform body has a rear edge that extends in the first direction, and opposite lateral edges. The first mounting shaft 341 is mounted on the rear edge of the platform body, and has opposite ends 3411 connected respectively and pivotally to the right and left endless chains 31, 32. The second mounting shaft 342 is spaced apart from the first mounting shaft 341 in a third direction transverse to the first and second directions, and has opposite ends 3421. Each of the linking plates 343 has a first end 3431 mounted on a respective one of the lateral edges of the platform body, a second end 3432, and a curved guide slot 3433 extending from the first end 3431 to the second end 3432. The opposite ends 3421 of the second mounting shaft 342 extend slidably and respectively through the guide slots 3433 in the linking plates 343, and are connected respectively and pivotally to the right and left endless chains 31, 32. The second mounting shaft 342 and the linking plates 343 support the platform body in a generally horizontal position when the platform member 34 is aligned with the front side of the frame body 10, and permits the platform body to be folded toward the ladder unit 30 when the platform member 34 is aligned with the rear side of the frame body 10.

Figure 5:
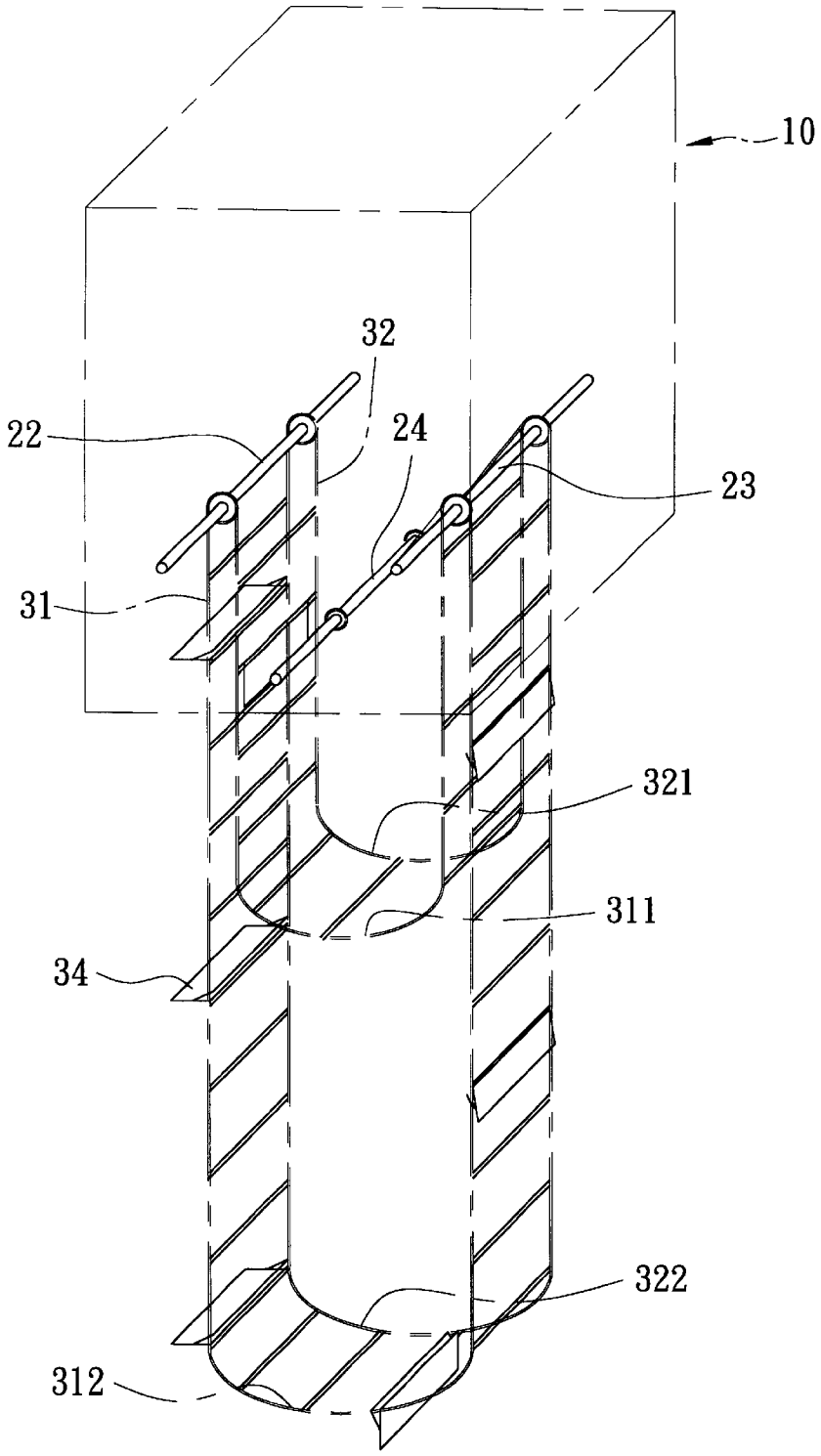
FIG. 5 is another fragmentary perspective view of the preferred embodiment, illustrating folding of endless chains.
Figure 6:
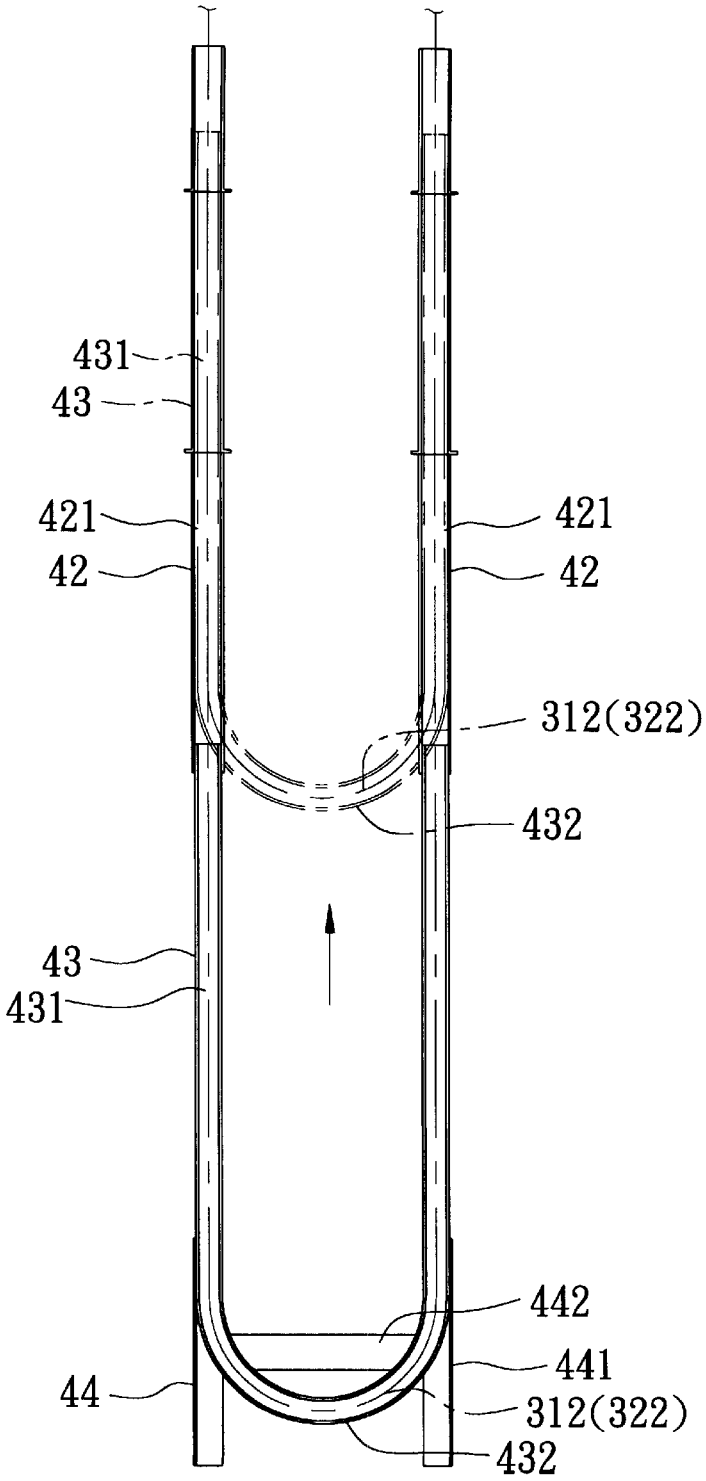
FIG. 6 is a side view of the preferred embodiment, illustrating how movable chain support frames of the ladder support unit are retracted during folding of the endless chains.

With further reference to FIGS. 5 and 6, when the preferred embodiment is not in use, the motor unit 21 can be actuated to drive the transmission wheel 212 to rotate in a clockwise direction, thereby bringing the first chain wheels 221 on the first chain shaft 22, which is coupled to the transmission wheel 212, to rotate synchronously therewith via the belt pulley 222. During clockwise rotation of the first chain shaft 22, since the second chain shaft 24 is not disposed to rotate therewith, the upper chain portions 311, 321 will extend downwardly relative to the second chain shaft 24, while the lower chain portions 312, 322 will move upwardly toward the upper chain portions 311, 321, thereby shortening the vertical length of the endless chains 31, 32. In addition, during elevation of the lower chain portions 312, 322, the movable chain support frames 43 having the chain grooves 431 that retain the lower chain portions 312, 322 are brought to move upwardly and to be retracted telescopically into the stationary chain support frames 42 until further upward movement thereof is inhibited by the curved connecting portions 432 of the movable chain support frames 43, or until the movable chain support frames 43 have been raised to an elevation approximately two floors above the ground surface. In this way, the vertical length of the device of the present invention can be shortened.

Figure 7:
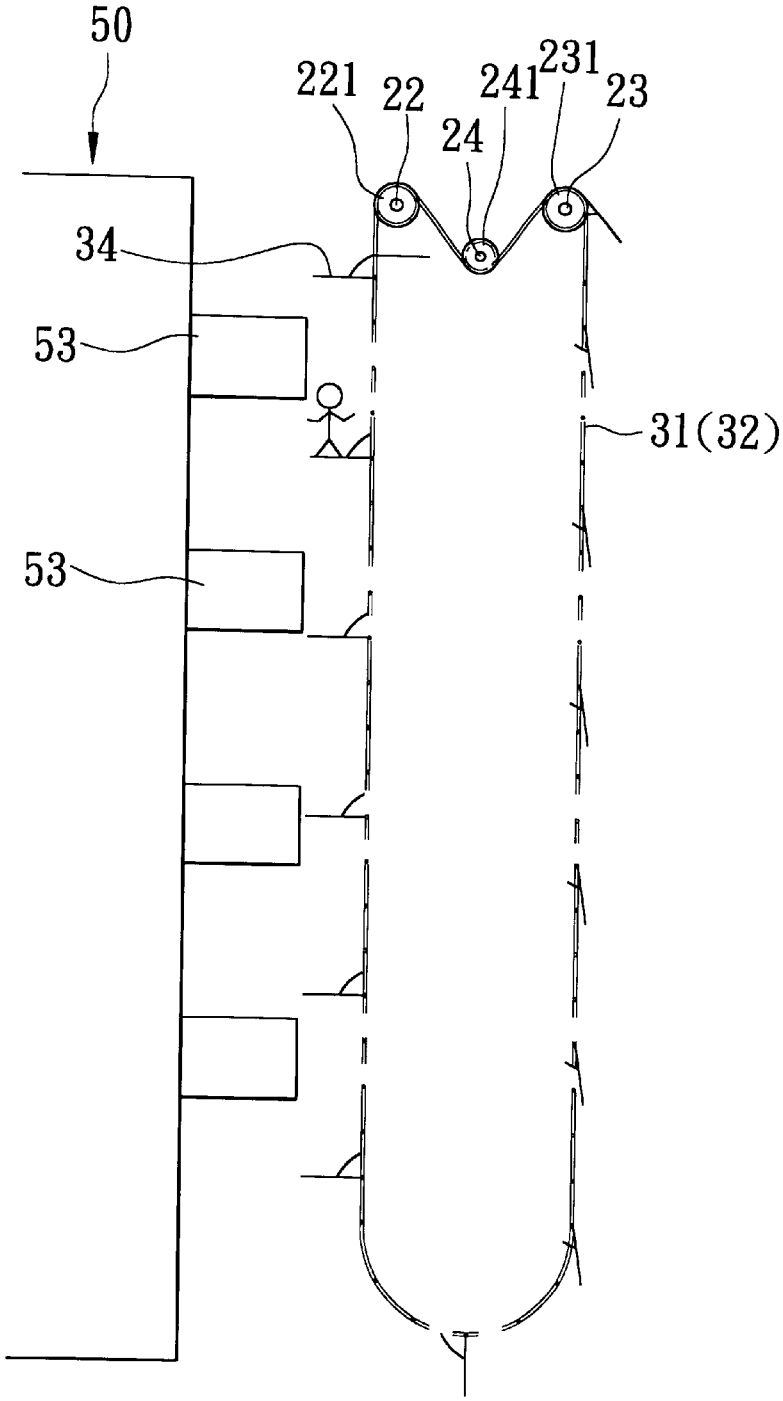
FIG. 7 is a schematic side view illustrating the preferred embodiment in a state of use.

Referring to FIG. 7, when a fire unfortunately breaks out, the motor unit 21 can be actuated to cause the transmission wheel 212 to rotate in a counterclockwise direction, thereby bringing the first chain shaft 22 to rotate synchronously therewith. Counterclockwise rotation of the first chain wheels 221 results in counterclockwise rotation of the endless chains 31, 32 so that the upper chain portions 311, 321 are elevated toward the second chain shaft 24 while the lower chain portions 312, 322 move downwardly, thereby resulting in downward extension of the movable chain support frames 43 from the stationary chain support frames 42 into the receiving space of the base frame 44. When one of the platform members 34 is aligned with the outer wall 53 of one of the floors 52 of the building 50, an occupant of the building 50 can hold on to the linking bar 33 above the platform member 34 and stand on the platform member 34, which will move downwardly with the counterclockwise rotation of the endless chains 31, 32 to enable the occupant to reach the ground surface. In this way, a number of occupants can be rescued to safety at the same time. Preferably, in the event of power failure, when an occupant stands on the platform member 34, the motor unit 21 is designed so that the weight of the occupant will cause the endless chains 31, 41 to move downwardly toward the ground surface. Therefore, the motor unit is preferably provided with a brake device (not shown) to check the speed of circulation of the endless chains 31, 32 so as to ensure safety.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An emergency escape device adapted to be installed on a building, said emergency escape device comprising:

a hollow frame body adapted to be mounted on an outer wall surface of an uppermost floor of the building, said frame body having left and right sides opposite to each other in a first direction, and front and rear sides opposite to each other in a second direction transverse to the first direction;

a drive unit including a first chain shaft mounted rotatably on said frame body and extending in the first direction adjacent to said front side of said frame body, said first chain shaft having left and right end portions, each of which has a first chain wheel mounted thereon, a second chain shaft mounted rotatably on said frame body and extending in the first direction adjacent to said rear side of said frame body, said second chain shaft having left and right end portions, each of which has a second chain wheel mounted thereon, a third chain shaft mounted rotatably on said frame body and extending in the first direction, said third chain shaft being disposed between and at an elevation below said first and second chain shafts, said third chain shaft having left and right end portions, each of which has a third chain wheel mounted thereon, a bi-directional motor unit mounted on said frame body, and a transmission unit for coupling said motor unit to said first chain shaft so as to transmit rotary drive power from said motor unit to said first chain shaft; and a ladder unit including a right endless chain having a curved upper chain portion extending into said frame body, a curved lower chain portion disposed downwardly and outwardly of said frame body, and an intermediate portion between said upper and lower chain portions, said upper chain portion of said right endless chain being trained in sequence on an upper part of one of said first chain wheels, a lower part of one of said third chain wheels and an upper part of one of said second chain wheels, a left endless chain having a curved upper chain portion extending into said frame body, a curved lower chain portion disposed downwardly and outwardly of said frame body, and an intermediate portion between said upper and lower chain portions, said upper chain portion of said left endless chain being trained in sequence on an upper part of the other one of said first chain wheels, a lower part of the other one of said third chain wheels and an upper part of the other one of said second chain wheels, and a plurality of linking bars, each of which extends in the first direction and has opposite ends connected respectively to said right and left endless chains, said linking bars being spaced apart from each other along lengths of said right and left endless chains, and a ladder support unit including:

left and right stationary chain support frames, each of which includes front and rear upright frame portions that are spaced apart from each other in the second direction and that respectively define a vertically extending chain groove, said chain grooves in one of said stationary chain support frames opening toward the other one of said stationary chain support frames;

left and right U-shaped movable chain support frames, each of which includes parallel branch portions that have upper sections extending telescopically and respectively into said chain grooves of said upright frame portions of a corresponding one of said stationary chain support frames, and a curved connecting portion interconnecting lower sections of said parallel branch portions, each of said movable chain support frames having a U-shaped chain groove that is formed there along and that opens toward the other one of said movable chain support frames; and a plurality of frame mounting members, each of which is connected to one of said stationary chain support frames at one end, and is adapted to be mounted on an outer wall portion of a respective one of upper floors of the building at the other end, thereby securing said stationary chain support frames on an upper part of the building; said intermediate portion of each of said right and left endless chains extending into said chain grooves in a respective one of said stationary chain support frames;

said lower chain portion of each of said right and left endless chains being received in said chain groove in a respective one of said movable chain support frames.

2. The emergency escape device of claim 1, wherein said ladder support unit further includes a base frame adapted to be disposed on a ground surface and confining an upwardly opening receiving space that permits extension of said movable chain support frames therein when said movable chain support frames are extended downwardly from said stationary chain support frames so as to position said movable chain support frames relative to the ground surface.

3. A emergency escape device adapted to be installed on a building, said emergency escape device comprising:

a hollow frame body adapted to be mounted on an outer wall surface of an uppermost floor of the building, said frame body having left and right sides opposite to each other in a first direction, and front and rear sides opposite to each other in a second direction transverse to the first direction;

a drive unit including a first chain shaft mounted rotatably on said frame body and extending in the first direction adjacent to said front side of said frame body, said first chain shaft having left and right end portions, each of which has a first chain wheel mounted thereon, a second chain shaft mounted rotatably on said frame body and extending in the first direction adjacent to said rear side of said frame body, said second chain shaft having left and right end portions, each of which has a second chain wheel mounted thereon, a third chain shaft mounted rotatably on said frame body and extending in the first direction, said third chain shaft being disposed between and at an elevation below said first and second chain shafts, said third chain shaft having left and right end portions, each of which has a third chain wheel mounted thereon, a bi-directional motor unit mounted on said frame body, and a transmission unit for coupling said motor unit to said first chain shaft so as to transmit rotary drive power from said motor unit to said first chain shaft; and a ladder unit including a right endless chain having a curved upper chain portion extending into said frame body, a curved lower chain portion disposed downwardly and outwardly of said frame body, and an intermediate portion between said upper and lower chain portions, said upper chain portion of said right endless chain being trained in sequence on an upper part of one of said first chain wheels, a lower part of one of said third chain wheels and an upper part of one of said second chain wheels, a left endless chain having a curved upper chain portion extending into said frame body, a curved lower chain portion disposed downwardly and outwardly of said frame body, and an intermediate portion between said upper and lower chain portions, said upper chain portion of said left endless chain being trained in sequence on an upper part of the other one of said first chain wheels, a lower part of the other one of said third chain wheels and an upper part of the other one of said second chain wheels, and a plurality of linking bars, each of which extends in the first direction and has opposite ends connected respectively to said right and left endless chains, said linking bars being spaced apart from each other along lengths of said right and left endless chains, and a plurality of foldable platform members, each of which includes:

a rectangular platform body having a rear edge that extends in the first direction, and opposite lateral edges;

a first mounting shaft mounted on said rear edge of said platform body and having opposite ends connected respectively to said right and left endless chains;

a second mounting shaft spaced apart from said first mounting shaft in a third direction transverse to the first and second directions and having opposite ends connected respectively to said right and left endless chains; and a pair of linking plates, each of which has a first end mounted on a respective one of said lateral edges of said platform body, a second end, and a curved guide slot extending from said first end to said second end, said opposite ends of said second mounting shaft extending slidably and respectively through said guide slots in said linking plates;

said second mounting shaft and said linking plates supporting said platform body in a generally horizontal position when said platform member is aligned with said front side of said frame body, and permitting said platform body to be folded toward said ladder unit when said platform member is aligned with said rear side of said frame body.

* * * * *